United States Patent [19]

Ngai

[11] Patent Number: 4,698,734

[45] Date of Patent: Oct. 6, 1987

[54] LENSED INDIRECT LUMINAIRE WITH SIDE ANGLE BRIGHTNESS CONTROL

[75] Inventor: Peter Y. Y. Ngai, Danville, Calif.

[73] Assignee: Peerless Lighting Corporation, Berkeley, Calif.

[21] Appl. No.: 616,076

[22] Filed: Jun. 1, 1984

[51] Int. Cl.[4] ..... F21V 5/02

[52] U.S. Cl. ..... 362/225; 362/244; 362/337

[58] Field of Search ..... 362/223, 225, 235, 240, 362/244, 246, 260, 290, 291, 308, 311, 326, 329, 330, 335, 336, 337, 338, 339, 340, 227, 245

[56] References Cited

U.S. PATENT DOCUMENTS

| | | | |
|---|---|---|---|
| 2,474,308 | 11/1949 | Franck et al. . | |
| 2,474,341 | 6/1949 | Wince . | |
| 2,662,165 | 12/1953 | Franck | 362/227 |
| 3,591,798 | 7/1971 | Florence | 362/225 |
| 3,647,148 | 3/1972 | Wince . | |
| 3,711,704 | 1/1973 | Spiteri | 362/337 |
| 4,371,916 | 2/1983 | De Martino | 362/337 X |
| 4,390,930 | 6/1983 | Herst et al. | 362/224 |
| 4,488,208 | 12/1984 | Miller | 362/340 X |

FOREIGN PATENT DOCUMENTS

| | | | |
|---|---|---|---|
| 0216622 | 8/1958 | Australia | 362/337 |
| 0597466 | 8/1959 | Italy | 362/337 |
| 0039980 | 3/1979 | Japan . | |
| 0039981 | 3/1979 | Japan . | |
| 80/02735 | 12/1980 | World Int. Prop. O. . | |

*Primary Examiner*—Willis R. Wolfe, Jr.
*Attorney, Agent, or Firm*—Donald L. Beeson

[57] ABSTRACT

An indirect luminaire which has an opaque housing that masks light directed downwardly of the luminaire is provided with an elevated light source, that is, a light source which is elevated relative to the side walls of the luminaire housing. Luminaire lenses extend upwardly from the side walls to receive generally laterally directed light and to redirect same. The luminaire lenses are formed to receive laterally directed light from the elevated light source and to refract same in a direction near or above the horizontal plane of the fixture such that the pervasive problem of excessive brightness in certain prismatic surfaces is substantially eliminated. Also disclosed is two level lighting employing an elevated light source and a lens in accordance with the invention and a second light source directly beneath the elevated light source in an over/under relation. The disclosed two level lighting provides two levels of light without disturbing the symmetry of the light distribution pattern of the luminaire.

25 Claims, 10 Drawing Figures

| PRISM | ANGLE | DEG |
|---|---|---|
| 0 | A | — |
| 1 | A | — |
| 2 | A | — |
| 3 | A | — |
| 4 | A | — |
| 5 | A | — |
| 6 | A | — |
| 7 | A | — |
| 8 | A | — |
| 9 | A | — |
| 10 | A | — |
| 11 | A | — |
| 12 | — | — |

| PRISM | ANGLE | DEG |
|---|---|---|
| 13 | B | 89 |
| 14 | B | 87 |
| 15 | B | 86 |
| 16 | B | 85 |
| 17 | B | 83 |
| 18 | B | 82 |
| 19 | B | 81 |
| 20 | B | 79 |
| 21 | B | 77 |
| 22 | B | 75 |
| 23 | B | 73 |
| 24 | B | 72 |
| 25 | B | 71 |

| PRISM | ANGLE | DEG |
|---|---|---|
| 26 | B | 69 |
| 27 | B | 67 |
| 28 | B | 65 |
| 29 | B | 63 |
| 30 | B | 61 |
| 31 | B | 59 |
| 32 | B | 57 |
| 33 | B | 55 |
| 34 | B | 53 |
| 35 | B | 51 |
| 36 | B | 50 |
| | | |
| | | |

LENSED INDIRECT LUMINAIRE WITH SIDE ANGLE BRIGHTNESS CONTROL

BACKGROUND OF THE INVENTION

The present invention relates to luminaires generally, and more particularly relates to indirect luminaires which illuminate a space by reflecting light off interior ceiling and wall surfaces. Still more particularly the invention relates to an indirect luminaire employing a lens to spread the light directed from the luminaire.

The concept of indirect lighting has been known for many years. Conventionally a light source is hidden totally from view within an opaque luminaire housing. Light is directed generally upwardly and laterally out of a top opening in the housing toward an overhead ceiling or adjacent side wall surface, or both. The illuminated ceiling and/or wall surfaces thusly become the effective light source. In recent years attention has been given to controlling the distribution of light emitted by an indirect fixture by the addition of a lens or lenses to the fixture's top opening. The principal objective of such light control is to evenly spread the light over the reflecting wall/ceiling surfaces; another objective has to be to provide the psychological perception of seeing the light source in the visible part of the lens. For example, one form of indirect fixture lens is disclosed in U.S. Pat. No. 4,390,930 wherein a small controlled amount of light is directed below the horizontal plane of the fixture to give a hint of brightness to the lens for visually locating the light source while preventing excess brightness.

Recent use of lenses on indirect luminaires have been on what are known as linear lighting fixtures, which are fixtures having a lens and housing of a uniform cross-section throughout its length, and which are typically straight and elongated. The lenses, which are fabricated of an extruded plastic and have elongated linear prisms which run longitudinally of the lens, are removably secured to the top edge of the fixture housings. One of the pervasive problems in such linear fixtures has been the problem of excessively bright strips of light appearing along certain of the elongated prisms of the fixture's lens. Such excessive brightness is generally difficult to eliminate in all of the prisms, and their presence can produce enough discomforture to detract from the fixture's overall pleasing appearance. One recent solution to this excess brightness problem has been to mask certain normally occurring bright strips as disclosed in co-pending application Ser. No. 596,811 now U.S. Pat. No. 4,573,111.

Using conventional lens designs, the problem of excessive lens brightness due to overly bright prisms increases as the fixture's lamps are raised within the fixture's housing. Excessive brightness can generally be avoided by positioning the fixture's lamps well within the housing itself. If the lamps are raised to approximately the level of the top of the housing side walls, it has been found that excessive lens brightness will often occur at certain horizontal angles as the viewer walks around the fixture, normally at side angles as opposed to a 90° angle where the leans of the fixture is being looked at directly from the side. These high brightness area are sometimes referred to as "hot spots" or "flashes" on the lens. Elevating the lamp position still further generally exacerbates the problem of hot spots, and can create a condition where excessive brightness appears in the prismatic lens for all horizontal angles.

In a lensed indirect fixture it would be advantageous to elevate the light source to a position above the top of the housing so that more light from the lamp passes directly through the lens. This, in many cases, will achieve increased fixture efficiency and will also permit another discovered advantage in a two way lighting design mentioned below.

In the present invention a prismatic lens of an indirect luminaire has been devised which will take the light from an elevated light source, that is, a light source positioned substantially above the top of the fixture housing, and redirect the light near or above the luminaire's horizontal plane so as to eliminate excess brightness in the lens for all horizontal angles of viewing. It has specifically been discovered that excessive brightness which occurred in previous lens designs was caused in large part by light transmitted through the lens from a horizontal side angle relative to the lens surface, as opposed to light having a 90° or perpendicular angle of incidence to the lens. Thus, the present invention specifically provides an indirect luminaire having a lens which solves the problem of excessive brightness caused by side angle light.

As above mentioned, the elevated light source of the invention provides another advantageous luminaire design. It is noted that heretofore fluorescent indirect luminaires have typically been provided with one, two or three lamp configurations. The multi-lamp configurations have been achieved by placing the fluorescent lamps in a side-by-side relation. Such a side-by-side lamp configurations have in part been dictated by space considerations where the objective has been to position the lamps down within the fixture housing.

In normal operation all lamps of a multi-lamp fixture would be illuminated at the same time, however, in recent years it has become desirable to design lighting fixtures with two level lighting wherein the fixture can be switched to turn on all lamps or less than all lamps. Such two-level lighting permits the control of light level at different times of the day for energy conservation purposes. The difficulty with such two-level lighting in a symmetrical indirect luminaire having a light spreading lens is that the low level of the two-level lighting, where a single off center lamp would typically be illuminated, will normally cause the source of light to be asymmetric relative to the lens thereby disturbing the overall light distribution pattern of the luminaire. Therefore, as the luminaire is switched from one level to the next the performance of the fixture in terms of light distribution visibly changes. It will be seen that a further aspect of the present invention is to provide a linear indirect luminaire with at least two switchable lamps wherein the light source is symmetric to the luminaire lens regardless of whether one lamp or both lamps are illuminated.

SUMMARY OF THE INVENTION

In the present invention a lensed indirect luminaire is comprised of an opaque housing having a bottom portion and at least one side wall extending upwardly from the bottom portion to a top edge which extends substantially in and serves to define a horizontal plane. A light source is mounted to the housing, and a reflector means is secured below the light source for reflecting back light directed downwardly into the housing. In the illustrated embodiment the light source is in a vertically elevated position relative to the top of the housing proximate the top of the lens cavity. As will be discussed, the vertical elevation of the lamps will affect the overall brightness of a fixture's lenses, but it will be understood that the basic principal of the invention, that of correcting for the problem of hot spots on the lens occurring at side viewing angles, will apply regardless of the lamps vertical elevation. The lens of the invention is secured to the top edge of the housing and extends generally upwardly from this top edge to a sufficient height to receive generally laterally directed light emitted from the light source. As will be described below in the detailed description, the light source, which has a finite surface area, will emit light in different directions in the horizontal plane of the fixture, so that light will be transmitted through the lens at different angles of incidence. The lens of the invention is formed to refract light incident thereon from different horizontal plane angles such that the light have horizontal plane angles that are not perpendicular to the lens surface (horizontal plane side angles) are refracted generally in a more upwardly direction than light from the light source that has a perpendicular horizontal plane angle of incidence. So formed, a luminaire that is comfortable when viewed at a perpendicular or a 90° horizontal viewing angle will not exhibit undesired hot spots or flashes as an observer moves around the fixture to side angles of observation.

In the illustrated embodiment of the invention, the housing and lens are of a linear construction, that is, the lens and housing are substantially uniform in their cross-sectional shape over the extent of the fixture. In the drawings, the linear fixtures are primarily shown to be straight elongated fixtures wherein the housing has two side walls extending upwardly from its bottom portion and wherein the lens extends upwardly from the top edge of each of the housing side walls. However, it shall be understood that the concept of the invention equally applies to linear fixtures which are not straight line luminaires, but which have curved configurations, or which have housings with perimeter lenses and centrally mounted point sources of light such as shown in FIGS. 3 and 4. It is also understood that the housing of a straight line luminaire may have only one side wall over which light is directed such as would be the case for a wall mounted luminaire as opposed to a suspended luminaire.

In a further aspect of the invention, a second light source is mounted to the housing substantially directly below the first elevated light source such that the first and second light sources are disposed in the fixture in an over/under relation whereby the symmetry of the light source relative to the surrounding lens element or elements is maintained regardless of whether both lamps are on or only one of the lamps are on.

It is therefore a primary object of the invention to provide a lensed indirect luminaire having an elevated light source wherein excess brightness in the luminaire's lens is substantially eliminated. It is another object of the invention to specifically provide a lens which will take the side angle incident light from the light source as well as perpendicular incident light and redirect same substantially near or above the horizontal plane of the fixture such that excessive brightness does not appear in the lens. The foregoing and additional features, advantages and objectives of the invention will become more readily apparent from the description of specific illustrated embodiments of the invention presented below in conjunction with the accompanying drawings which are described as follows:

DETAILED DESCRIPTION OF THE ILLUSTRATED EMBODIMENT

Figure 1:
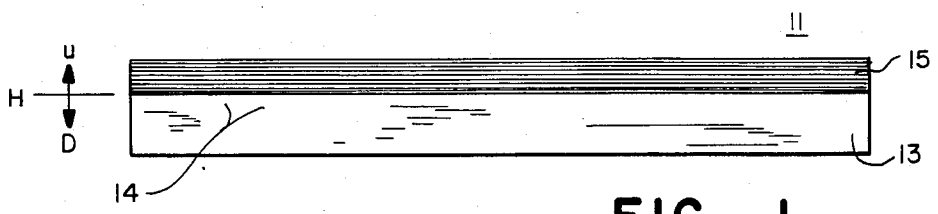
FIG. 1 is a front elevational view of a straight elongated linear indirect luminaire having an elongated linear lens.
Figure 2:
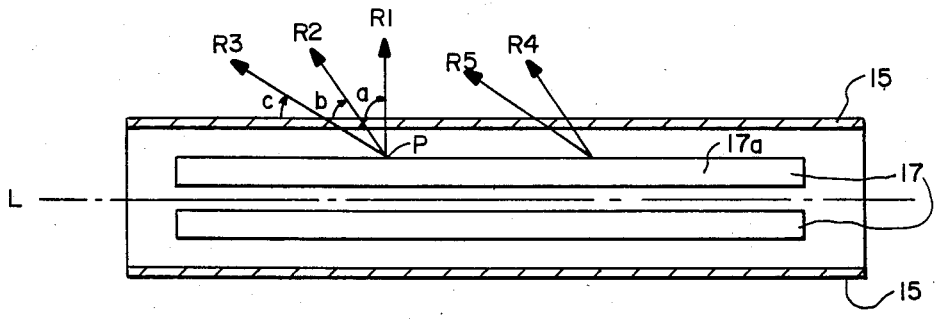
FIG. 2 is a top plan view of the indirect luminaire of FIG. 1, showing the directionality of the light emitted by the luminaire's light source in the horizontal plane of the luminaire.

Referring now to the drawings, FIGS. 1 through 4 illustrate pictorially two different shapes of indirect luminaires, each of which has an opaque housing, light source and lens. In FIGS. 1 and 2 there is shown an linear elongated luminaire 11 having a straight elongated opaque housing 13, elongated lenses 15 upwardly extending from the housing side walls 14, and an elongated light source in the form of two side-by-side fluorescent lamps 17. Light might be generated by other light sources such as rows of incandescent lamps. Light from fluorescent lamps 17 is emitted from the lamps' light emitting surfaces generally in all directions. In reference to FIG. 1, light directed generally in the downward direction, as denoted by the arrow D, is masked by the luminaire's opaque housing 13, while light directed in a generally upward direction, as denoted by the arrow U, and generally laterally of the fixture above the housing side walls 14, is transmitted out of the luminaire either through fixture lenses 15 or through any top opening in the fixture not covered by a lens.

Figure 3:
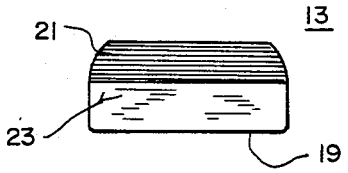
FIG. 3 is a front elevational view of a circular indirect luminaire having a lens.
Figure 4:
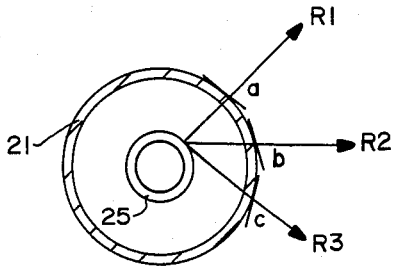
FIG. 4 is a top plan view of the indirect luminaire of FIG. 3, showing the directionality of the light emitted by the luminaire's source in the horizontal plane of the luminaire.

An alternative configuration of an direct fixture in accordance with the invention is illustrated in FIGS. 3 and 4 wherein a disk shaped opaque housing 19 supports an upwardly extending lens 21 placed around the perimeter of the housing side wall 23. The fixture has a light source 25 mounted centrally of the housing 29 such that light from its light emitting surfaces is directed upwardly and generally radially outwardly through lens 21. The light source 25 could be a doughnut shaped fluorescent lamp or any other type of source, such as an incandescent bulb.

It is seen that the respective housing side walls 14, 23 of the elongated and circular luminaires 11, 13 shown in FIGS. 1 through 4, generally extend in horizontal plane, denoted by the letter H. Below this plane any direct light from luminaire light sources 17, 25 is substantially masked by the fixture's opaque housings 13, 19. To understand the light bending function of the side portion of the luminaire's lenses 15, 21 it is important to observe that in the horizontal plane H, the luminaire's light sources 17, 25, at any point on the sources' light emitting surface, emits light in different directions. Consider in FIG. 2 light rays R1, R2, and R3 emitted from point P on fluorescent lamp 17*a*. Light ray R1 is emitted in a perpendicular direction relative to lens 15, that is, the horizontal plane angle of incidence, a, of light ray R1 on lens 15 is 90°. It is seen on the other hand that light rays R2 and R3 are received by lens 15 at a side angle and do not pass through lens 15 at a right angle. In the case of ray R2 the horizontal plane angle of incidence, b, is less than 90° whereas in the case of ray R3 the horizontal plane angle of incidence, c, is smaller than horizontal plane incident angle b.

Figure 2A:
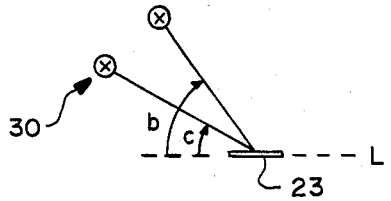
FIG. 2*a* is a pictorial view of the indirect luminaire of FIGS. 1 and 2 showing the relative position of an observer to the luminaire at different horizontal angles of observation.

In terms of an observer standing at a distance away from the luminaire 11, the luminaire in reference to the observer will be viewed from a particular horizonatal angle of observance. For example, referring to FIG. 2A assume an observer 30 is standing at a distance from luminaire 23 at an angle b relative to the fixture's axis, denoted L, to which the lens 15 is parallel. Such an observer would see light rays emerging from the fixture at this angle, such as light rays R2 and R4 illustrated in FIG. 2. If the observer moves around the fixture toward the fixture's axis L to an horizontal angle c, the observer will see light rays emitted instead at this angle, such as rays R3 and R5 in FIG. 2. It has been discovered that in linear prismatic lenses—that is, lenses where prisms of uniform cross-sectional shape run substantially the length of the lens, or, in the FIG. 3 luminaire, run the circumference of the lens—the horizontal angle of incidence on the lens will, as hereinafter described, affect the vertical bending of the light. It has been discovered that rays R1, R2 and R3 behave differently in the vertical plane as they are transmitted through a linear prismatic lens 15.

Consider also light rays R1, R2 and R3 emitted from light source 25 of the circular luminaire 13 shown in FIG. 4. Similar to the light rays illustrated for the straight elongated fixture of FIGS. 1 and 2, the light rays R1, R2 and R3 of FIG. 4 pass through the circular prismatic lens 21 in the horizontal plane H at different horizontal plane angles of incidence a, b, c. Once again, linear prismatic surfaces running the circumference of the circular lens 21 will bend these light rays differently in the vertical plane depending on the light's angle of incidence to the lens.

Figure 5:
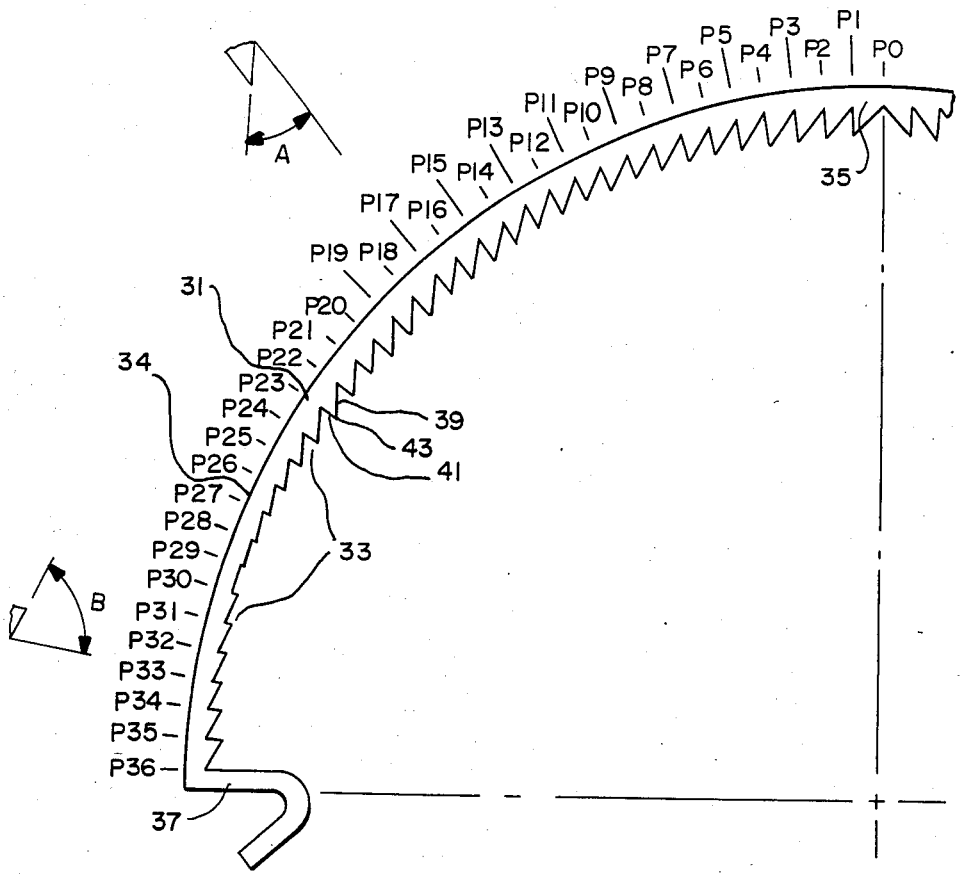
PRIOR ART FIG. — 5
FIG. 5 is an end elevation view of a linear prismatic lens as used on prior indirect luminaires.

Turning to the linear prismatic lens, FIG. 5 shows a prior version of a linear prismatic lens 31 such as used on elongated linear luminaires of the type generally illustrated in FIGS. 1 and 2. FIG. 5 generally illustrates one-half of a full 180° cylindrical lens cover which extends substantially the full length of the fixture. A plurality of interior linear prisms 33 are distributed from the top of the lens 35 down to the lens base 37 to form an interior prismatic surface which is opposed by a smooth exterior lens surface 34. Each of the separate prisms, denoted P0–P36, are defined by a primary working surface, a base surface and a prism apex. Consider, for example, the working surface 39 of prism P23, which is angled with respect to the lens and which receives most of the incident light from the luminaire's light source mounted within the luminaire's housing. Prism P23 is further defined by prism base surface 41 and the prism apex 43 which is formed by the intersection of the working surface and base surface.

Figure 7:
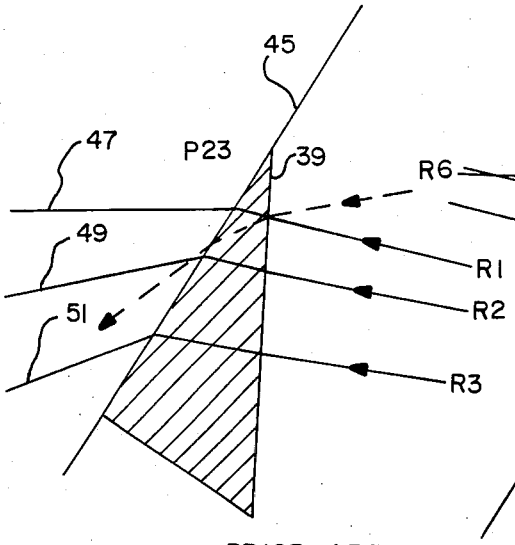
PRIOR ART FIG.—7
FIG. 7 is a representation of an interior prism on the prismatic lens of FIG. 5, showing the light bending characteristics of said prism.

In connection with the prior lens of FIG. 5 it is generally seen that to spread the light from the indirect fixture light source (conventionally mounted down within the fixture housing) the prisms above prism P29 each have a prism base which faces downwardly toward the lens base 37. The resulting light bending characteristics of such a prismatic configuration is illustrated in FIG. 7 wherein light rays R1, R2, R3 for three different horizontal angles as illustrated in FIGS. 1–4 are traced through the prism in the vertical plane. Consider ray R1 which is the perpendicular ray having a horizontal angle of incidence of 90°. This ray, like rays R2 and R3, are shown as being directed at the prism's primary working surface 39 from a position below the prism, indicating a light source position below the prism. The two refracting surfaces through which the light ray passes are the prism's primary working surface 39 and the lenses exterior surface 34 (for illustration purposes the lens thickness is ignored in FIG. 7 by placing the exterior surface 34 of the lens against the prism). It is seen that the perpendicular ray R1 is bent downwardly slightly toward the horizontal as it emerges from the lens at 47. However, it is seen that a similar ray R2 having a horizontal angle of incidence as shown in FIG. 2 is bent slightly more downwardly as it emerges from the lens outer surface 45 as illustrated by the emerging ray 49. Similarly, the side angle ray R3 having an even smaller horizontal angle of incidence to the primary working surface 39 is bent still further below the horizontal as indicated by emerging ray 51. The effect of such a prior prismatic configuration is to produce some downwardly directed light, that is light directed below the horizontal plane of the fixture. And it is seen that the downwardly directed light in this example occurs with respect to side angle light only. It is further seen that if the light source were elevated the light rays incident on the primary working surface 39 of the prism of FIG. 7, as illustrated by light ray R6, would be bent even more downwardly having the effect of creating more brightness in the lens to an observer standing below and at a distance from the fixture.

Figure 6:
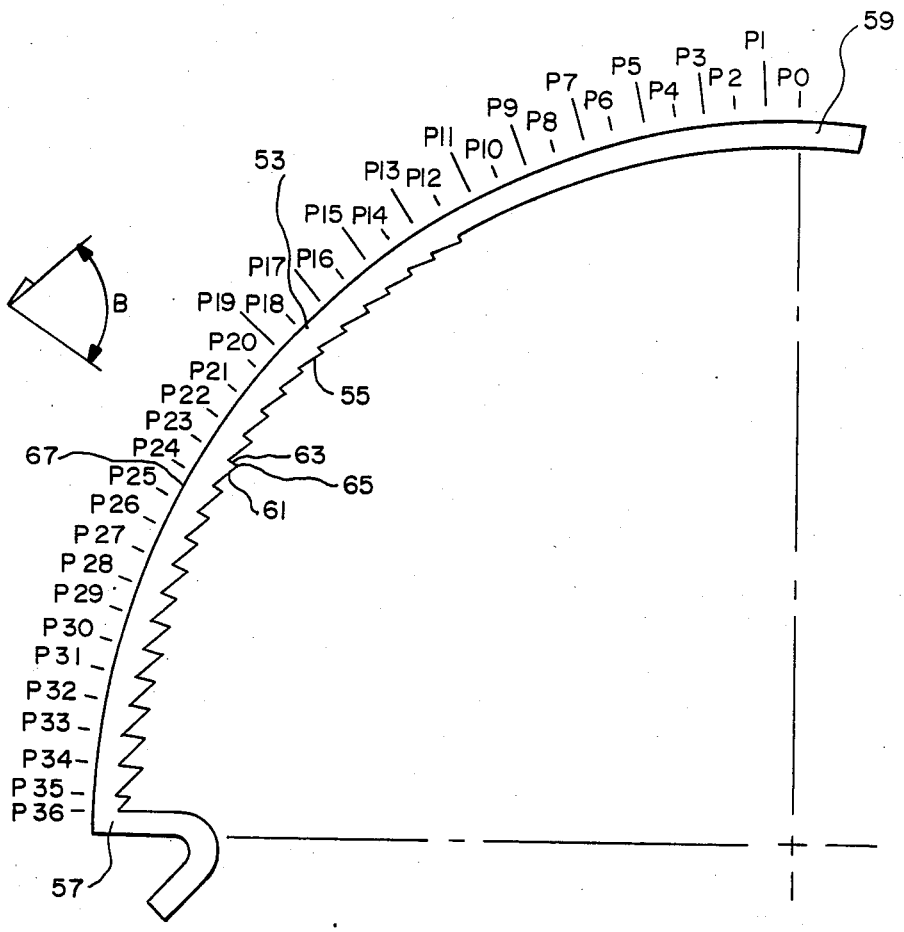
FIG. 6 is an end elevation view of a linear prismatic lens made in accordance with the invention together with a table identifying prisms and prism angles.

FIG. 6 illustrates a lens cover of the same general type illustrated in FIG. 5, except that the interior prismatic surface 55 of the lens 53 is formed with a prismatic configuration which achieves the objects of the invention, namely, to direct light from an elevated light source near and above the horizontal plane H of the fixture, but not below this plane, and to do so for substantially all horizontal plane angles. As is seen in FIG. 6, prisms are distributed in the lens 53 from the lens base 57 upwardly along a substantial portion of the inner circumference of the lens. For comparison sake, the lens of FIG. 6 is segmented into 36 prisms starting from the top 59 of the lens down to the lens base 57. However, unlike the FIG. 5 lens, the prisms are only formed on the interior of the lens up to prism P13, with the remaining top portion of the lens being comprised of a smooth interior surface, a well as a smooth lens exterior. Thus, the top portion of the lens illustrated in FIG. 6, above prism P13, is illustrated as having no light bending characteristics, but as simply transmitting the light without any redirection. It should be understood that, for the purposes of the invention, the top portion 59 of the lens 53 could as well be prismatic or a diffuser or any other design which does not affect the distribution of laterally directed light.

Figure 9:
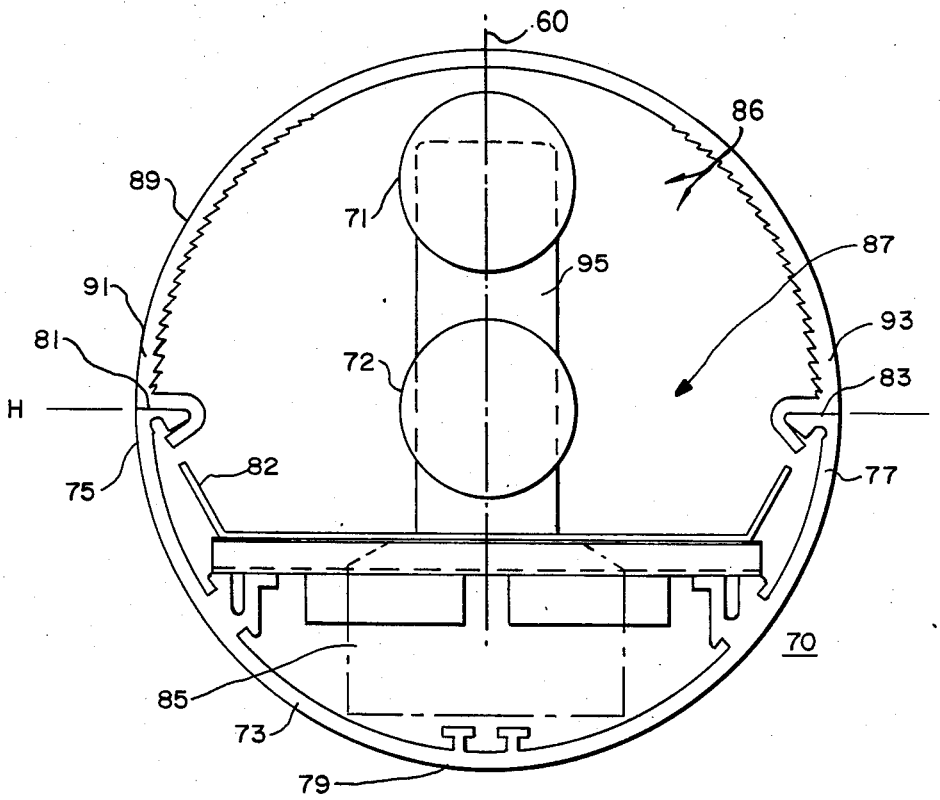
FIG. 9 is a cross-sectional view of a straight linear indirect luminaire such as shown in FIG. 1.

As for the prisms P13 through P36 of the FIG. 5 lens, these prisms are shown to extend over the side portion of lens 53 for approximately 60° of arc from the lens base 57 so as to receive and refract generally laterally directed light emitted from the luminaire's light source, such as the fluorescent lamps 71 and 72 shown in FIG. 9. Each of the prisms of the FIG. 6 lens, like the FIG. 5 lens, is defined by a primary working surface, a base surface and a prism apex. By way of illustration, prism 23 of the FIG. 6 lens has a primary working surface 61, an upwardly directed base surface 63, and an apex 65. It is seen that a special characteristic of the FIG. 6 lens which distinguishes it from the prior FIG. 5 lens is that each of the prisms 55 distributed over the lens' interior surface has its prism base facing toward the top 59 of the lens away from the lens base and that the primary working surface for each of the prisms is generally angled in the direction of the lens base and away from the lens top.

Figure 8:
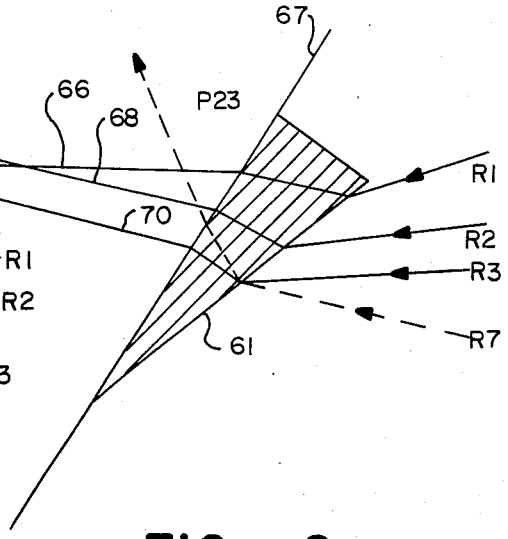
FIG. 8 is a representation of an interior prism on the lens of FIG. 6, showing the light bending characteristics of said prism.

The light bending properties of such an angled primary working surface are illustrated in FIG. 8 of the drawings wherein the three light rays R1, R2, R3 for three different horizontal angles as shown in FIG. 2 (or FIG. 4) are shown as incident upon prism P23 having, as light refracting surfaces, a primary working surface 61 and an exterior lens surface 67. It can be seen in FIG. 8 that, for each of the horizontal angles associated with light rays R1, R2, and R3, light is directed near or above the horizontal plane H of the fixture as indicated by the emerging ray traces 66, 68, 70. It is noted that the incoming traces for rays of R1, R2, and R3 indicate that the light source is higher within the luminaire than was the case of the ray traces for the inverted prism configuration shown in FIG. 7. Such would be the case if the light source is elevated within the luminaire as shown in respect to fluorescent lamp 71 of the luminaire illustrated in FIG. 9. If the source of light is lowered in respect to the FIG. 8 prism, it can readily be seen from the ray trace R7 that the lens will become less bright by virtue of the fact that the emerging light rays 66, 68, 70 will be bent in a more upwardly direction. Thus, with the FIG. 6 lens of the invention the optimum lens brightness, that is maximum brightness where no excessive brightness appears in the prismatic surfaces of the lens, occurs with an elevated lamp such as with the elevated lamps 71 in FIG. 9. Acceptable lens brightness without excessively bright prismatic surfaces occurs in the prior art FIG. 5 lens only with the light source positioned well down within the fixture's housing.

FIG. 9 illustrates a cylindrical indirect luminaire 70 in accordance with the invention showing in more detail various parts of the luminaire and showing lamp 71, 72 positioned in a unique over/under relationship for two-way lighting as hereinafter described. In FIG. 9 the indirect luminaire 70 is comprised of a cylindrical housing 73 having side walls 75, 77 extending upwardly from the bottom portion 79 of the housing to form top edges 81, 83. The top edges 81, 83 of the housing side walls extend substantially in a horizontal plane and define a horizontal plane H of the luminaire. The housing houses ballast 85 and associated wiring (not shown) for electrifying the fluorescent lamps 71, 72 it also houses a reflector 82 which reflects light from lamps 71, 72 through the luminaire's top opening 87.

The FIG. 9 fixture's lens cover 89 is of a construction identical to the FIG. 6 lens described above. The base of the lens is formed by the lens rims 91, 93 which as shown are releasably secured to the housing's top opening 87 along the top edges 81, 83 of the housing side walls 75, 77. The lens cover extends upwardly from the side walls to form a lens cavity 86 above the horizontal plane H of the fixture and the top lamp 71 is seen as being vertically positioned proximate the top of the cavity. While a lens cover 89 is shown fully enclosing the lamps 71, 72, it shall be understood that the lens need not provide a full enclosure to achieve the objects of the invention, but needs to extend generally upwardly from the top edges 81, 83 of the luminaire housing's side walls to a sufficient height to receive generally laterally directed light emitted from the lamps 71, 72, The lamps of the fixture should not be seen and a sufficient upwardly extension of the lens should therefore prevent light from the elevated lamp 71 from being viewable directly by an observer standing at an appreciable distance away from the luminaire. This is so-called high angle viewing where the angle of observing the luminaire is near horizontal and high relative to the down vertical axis of the fixture. Generally, the lens need only extend upwardly to form a lens cavity above the plane of the luminaire H so that a source of light, when vertically positioned high within this cavity, is above this plane.

As above noted, the lamps 71, 79 are supported in the fixture in an over/under relationship such that the topmost lamp 71 is positioned near the top of the lens cover 89. Lamps are removably held in place by conventional lamp sockets (not shown) supported on upright end brackets 95. It can readily be seen that a long luminaire section which exceeds standard lamp lengths can be provided with a number of lamps in alignment supported in the fixture as above described. Normally, aligned lamps would be simultaneously electrified but this need not be the case.

In accordance with the invention, two-level lighting can be provided in the FIG. 9 luminaire by electrically wiring lamps 71, 72 such that the luminaire can be switched to illuminate both the top and bottom lamps together, or switched to illuminate the top lamp only. By switching between these two states of illumination, it can be seen that in either illuminated condition the light from either of the two lamps 71, 72 will be symmetrically distributed to the prismatic lens 89. Therefore, switching between these two levels will change the light level, but will not change the symmetry of the overall light distribution characteristics of the lens.

Therefore, it is seen that the present invention is an indirect luminaire having an elevated light source and a prismatic lens formed to bend the light from the elevated source in a direction near the horizontal plane H of the fixture or above this plane and to do so for substantially all horizontal plane angles of observance. It is a particular feature of the lens of the indirect luminaire of the invention that light from the light source incident on the lens from side or off-perpendicular angles are generally refracted in the more upwardly direction then the light having the perpendicular angle of incidence to the lens. Excessive glare in the luminaire's lens is therefore substantially eliminated provided there is no flash or excessive brightness at perpendicular viewing angles. Such a luminaire permits the advantageous positioning of two lamps in the fixture in an over/under relation to achieve lighting symmetry in a two-way lighting system.

While the invention has been described in considerable detail in the foregoing specification, it is not intended that the invention be limited to such detail, except as necessitated by the appended claims.

I claim:

1. An indirect luminaire comprising a substantially cylindrically shaped, elongated, linear, opaque housing extending along a luminaire axis, said housing having a bottom portion and two side walls extending upwardly from opposite sides of said bottom portion to top edges which extend longitudinally of said housing in a horizontal plane defining a horizontal plane of said fixture, an elongated light source in the form of at least one fluorescent lamp mounted to and extending in parallel relation with said housing, said fluorescent lamp being vertically positioned substantially entirely above the horizontal plane of said housing, reflector means below said fluorescent lamp, and an elongated, substantially semi-cylindrically shaped lens cover extending in parallel relation to said light source and housing, said lens cover having a lens base formed by two parallel rims of said lens cover and said lens cover being secured along said parallel rims to the top edges of said housing side walls whereby said lens cover encloses said elevated light source and forms a lens cavity above the horizontal plane of said housing, the side portions of said cylindrically shaped lens having an interior prismatic surface extending upwardly from said lens base to proximate the top of said lens cavity and, said prismatic surface being comprised of a plurality of longitudinally extending prisms, each of said prisms of said prismatic surface being defined by a primary working surface, a base surface and a prism apex arranged so that the prism base surface faces upwardly away from the base of said lens so that the prisms primary working surface is angled toward said lens base relative to the plane of said lens.

2. The indirect luminaire of claim 1 wherein said lens cover is a full 180° lens.

3. The indirect luminaire of claim 1 wherein a second fluorescent lamp is mounted to said housing substantially directly below said first elevated light source in an over/under relation.

4. The indirect luminaire of claim 3 wherein the prismatic surfaces of said lens cover are substantially symetrical about the luminaire axis and wherein said first and second fluorescent lamps are electrically connected to be separately switchable whereby either the first and second of said fluorescent lamps can be simultaneously illuminated or only said first fluorescent lamp can be illuminated without substantially altering the luminaire's overall light distribution pattern.

5. The indirect luminaire of claim 4 wherein said first and second fluorescent lamps are centrally mounted between said housing side walls.

6. An indirect luminaire comprising an opaque housing, said housing having a bottom portion and at least one side wall extending upwardly from said bottom portion to form a top edge extending substantially in a horizontal plane, said horizontal plane defining a horizontal plane of said luminaire, a source of light, and a lens having a lens base, said lens extending upwardly from the top edge of said housing so as to form a lens cavity above the horizontal plane of said luminaire, and said lens including a light refracting prismatic surface extending upwardly from said lens base, substantially the entirety of said prismatic surface on said lens between said lens base and proximate the top of said lens cavity being formed to refract light incident thereon in a generally more upward direction and further being formed such that, for substantially all horizontal plane angles, light with horizontal plane side angles of incidence to said prismatic surface are refracted generally in a more upwardly direction than light incident from a perpendicular horizontal angle of incidence.

7. The indirect luminaire of claim 6 wherein at least a portion of said light source is vertically positioned proximate the top of said lens cavity.

8. The indirect luminaire of claim 6 wherein said housing and lens are elongated in shape and extend along a luminaire axis, and said light source extends in parallel relation to said housing and lens, whereby light emitted by said light source has perpendicular components and side angle components in the horizontal plane of said luminaire in relation to said luminaire axis.

9. The indirect luminaire of claim 8 wherein said light source includes at least one fluorescent lamp vertically positioned substantially entirely above the horizontal plane of said luminaire.

10. The indirect luminaire of claim 6 wherein a second light source is mounted to said housing substantially directly below said first elevated light source in an over/under relation.

11. The indirect luminaire of claim 10 wherein said first and second light sources are electrically connected to be separately switchable whereby either one or two of said light sources can be illuminated for two level lighting.

12. The indirect luminaire of claim 10 wherein said first and second light sources are electrically connected to be separately switchable whereby said first and second light sources may simultaneously be illuminated or only said first elevated light source can be illuminated.

13. An indirect luminaire comprising an elongated linear opaque housing extending along a luminaire axis, said housing having a bottom portion and at least one end wall extending upwardly from said bottom portion to a top edge which extends longitudinally of said housing substantially in a horizontal plane, said horizontal plane defining a horizontal plane of said luminaire, an elongated source of light, reflector means below said light source, and a linear elongated lens having a lens base, said lens extending upwardly from the top edge of said housing in parallel relation to said light source and housing so as to form a lens cavity above the horizontal plane of said luminaire, and said lens including a light refracting prismatic surface extending upwardly from said lens base, substantially the entirety of said prismatic surface on said lens between said lens base and proximate the top of said lens cavity being formed to refract light incident thereon in a generally more upward direction and further being formed such that, for substantially all horizontal plane angles, light with horizontal plane side angles of incidence to said prismatic surface are refracted generally in a more upwardly direction than light incident from a perpendicular horizontal angle of incidence.

14. The indirect luminaire of claim 13 wherein said lens is formed to have a plurality of longitudinally extending prisms distributed upwardly from said lens base over the inside surface of said lens for refracting incident light from said light source in a direction substantially near or above the horizontal plane of the fixture.

15. The indirect luminaire of claim 13 wherein the prismatic surface of said lens includes a plurality of longitudinally extending prisms defined by a primary working surface, a prism base surface, and a prism apex, and wherein the prism base surface for each of said plurality of prisms faces upwardly away from the base of said lens so that the prism's primary working surface is angled toward said lens base relative to the plane of the lens.

16. The indirect luminaire of claim 15 wherein said lens is of a substantially semi-cylindrical shape.

17. The indirect luminaire of claim 16 wherein said lens cover is a substantially 180° lens.

18. The indirect luminaire of claim 17 wherein the plurality of prisms formed on interior surface of said lens cover extend substantially from said lens base through an approximately 60° arc on said lens.

19. The indirect luminaire of claim 16 wherein said elongated light source is substantially centered within said luminaire and vertically positioned proximate the top of said lens cover.

20. The indirect luminaire of claim 19 wherein said light source is comprised of at least one fluorescent lamp.

21. The indirect luminaire of claim 19 wherein a second elongated light source is centrally mounted to said housing substantially directly below said first elevated light source in an over/under relation.

22. The indirect luminaire of claim 21 wherein the prismatic surfaces of said lens cover are substantially symetrically disposed about the center plane of said luminaire and said first and second light sources are electrically connected to be separately switchable whereby either one or two of the light sources can be illuminated for two level lighting without substantially altering the luminaire's overall light distribution pattern.

23. The indirect luminaire of claim 21 wherein the prismatic surfaces of said lens cover are substantially symetrically disposed about the center plane of said luminaire and said first and second light sources are electrically connected to be separately switchable whereby said first and second light sources may simultaneously be illuminated or only said first elevated light source may be illuminated without substantially altering the luminaire's overall light distribution pattern.

24. The indirect luminaire of claim 21 wherein each of said first and second light sources are comprised of at least one fluorescent lamp.

25. The indirect luminaire of claim 24 wherein said second light source is vertically positioned at approximately the height of said housing side wall.

* * * * *